US009808679B1

(12) United States Patent
Seluga

(10) Patent No.: US 9,808,679 B1
(45) Date of Patent: Nov. 7, 2017

(54) GOLF CLUB SHAFT CONNECTION ASSEMBLY

(71) Applicant: CALLAWAY GOLF COMPANY, Carlsbad, CA (US)

(72) Inventor: James A. Seluga, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 155 days.

(21) Appl. No.: 15/059,167

(22) Filed: Mar. 2, 2016

(51) Int. Cl.
*A63B 53/14* (2015.01)
*A63B 53/02* (2015.01)
*A63B 60/28* (2015.01)
*A63B 60/22* (2015.01)

(52) U.S. Cl.
CPC ..... *A63B 53/02* (2013.01); *A63B 53/14* (2013.01); *A63B 60/22* (2015.10); *A63B 60/28* (2015.10)

(58) Field of Classification Search
CPC ..... A63B 5353/14; A63B 60/28; A63B 60/22
USPC ..... 473/296, 322, 316
See application file for complete search history.

(56) References Cited

U.S. PATENT DOCUMENTS 5,586,946 A 12/1996 Haber et al.
5,997,412 A 12/1999 Benson
6,203,446 B1 * 3/2001 Collins ..... A63B 53/02 473/294
6,749,521 B1 6/2004 Benson
6,780,120 B2 8/2004 Murray
6,896,626 B2 5/2005 Drossos
8,147,348 B2 4/2012 Chol
8,257,193 B2 9/2012 Hocknell et al.
8,328,657 B1 12/2012 Demkowski et al.
8,425,344 B2 4/2013 Evans et al.
8,425,345 B2 4/2013 Wall et al.
8,454,451 B2 6/2013 Evans et al.
8,485,915 B2 7/2013 Evans
8,529,367 B2 9/2013 Evans et al.
8,568,246 B2 10/2013 Wall et al.
8,591,350 B2 11/2013 Evans et al.
8,678,944 B2 3/2014 Wall
8,747,247 B2 6/2014 Beach et al.
8,814,718 B1 8/2014 Rollinson et al.
8,834,288 B2 9/2014 Aguinaldo et al.
8,852,019 B2 10/2014 Evans et al.
9,155,947 B2 10/2015 Aguinaldo et al.
9,272,192 B1 3/2016 Brady
2002/0022533 A1 * 2/2002 Churovich ..... A63B 53/14 473/296
2009/0270197 A1 10/2009 Holtzman
2011/0077096 A1 3/2011 White
2011/0256949 A1 10/2011 Soracco et al.
(Continued)

*Primary Examiner* — Benjamin Layno
(74) *Attorney, Agent, or Firm* — Rebecca Hanovice; Michael Catania; Sonia Lari

(57) ABSTRACT

A golf club shaft connection assembly comprising first and second shaft sections, male and female adaptors, a hollow retainer, a spring, and a plurality of balls is disclosed herein. The male and female adaptors are each attached to the first and second shaft sections, respectively, preferably with a permanent adhesive. The male adaptor comprises a protrusion that fits within a keyed interior of the female adaptor, and moving the hollow retainer towards the male adaptor reversibly fixes the two adaptors together, while moving the hollow retainer towards the female adaptor allows the male adaptor to be removed from the female adaptor.

20 Claims, 6 Drawing Sheets

(56) References Cited

U.S. PATENT DOCUMENTS

| | | | | |
|---|---|---|---|---|
| 2013/0017899 | A1 | 1/2013 | Foster et al. | |
| 2016/0096090 | A1 * | 4/2016 | Knutson | A63B 53/10 473/296 |

* cited by examiner

GOLF CLUB SHAFT CONNECTION ASSEMBLY

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

Field of the Invention

The present invention relates to a golf club shaft assembly that allows for quick, semi-permanent shaft adjustments. More specifically, the present invention relates to a connection system that permits a golfer to adjust a shaft's characteristics, such as weight and length, using shaft components having different lengths.

Description of the Related Art

Customization of golf clubs to help golfers attain better shots has become a popular and more prevalent practice in recent years. Golf club manufacturers and designers have devised various features to allow club fitters and golf club players to adjust certain characteristics of their clubs. Such characteristics include loft, lie, face angle, center of gravity (CG) location, and club length.

Current technology provides two commonly used methods to adjust overall club length. One such method involves the destruction and removal of the grip on a shaft. Upon removal of the grip by peeling or tearing, the end portion of the shaft is trimmed to decrease the club length or an extension piece is affixed to the end of the shaft to increase its length. Aftermarket extensions are available specifically for this purpose; alternatively, extensions can be made from portions of other golf club shafts that are cut to the desired length and then inserted into the end of the first club's shaft. The extension piece must match the diameter of the existing shaft, so it is necessary at times to build up the diameter of the extension or existing shaft by adding layers of tape. This method requires that the user making the adjustments have access to potentially expensive new components and tools as well as having a high level of skill. It also causes damage to the original shaft and grip.

The second method of adjusting club length involves replacing the entire shaft and grip using a semi-permanent head-shaft connection device that some manufacturers offer with their clubs, particularly with drivers. The existing shaft may be removed from the driver head and replaced with a different shaft that has either a shorter or longer length. This method is not possible on all clubs, however, as the head must have hardware that allows for removal of the shaft and replacement with a new shaft without damaging the head.

A golfer who does not possess club altering skills or the necessary disposable income to purchase new components likely will be daunted by these two methods of adjusting club length. The first method requires the golfer to make use of several tools to remove the grip and cut the shaft if he or she desires a shorter length, and also to have materials such as tape and a replacement grip on hand to replace the grip and mend any damage caused to the shaft and grip. The skill set required to change the shaft length using this method is usually beyond the abilities of the average golfer, so the golfer would need to seek the services of a golf club fitter or technician to have their club length changed. The second method requires the golfer to buy an entirely new shaft at a different length, which can be very expensive, and also may require the golfer to retain a golf club fitter or technician to replace the shaft.

Ultimately, the two methods described above require an inventory of spare components and above average technical skill, particularly with regard to the first method. It is therefore desirable to facilitate the change of a club's length using a faster, easier, and less expensive connection system and method than is currently available.

BRIEF SUMMARY OF THE INVENTION

One aspect of the present invention is a shaft connection assembly that permits a golfer to quickly and securely adjust the length of his or her golf club shaft. The assembly can include upper shaft portions of varying lengths and a single lower shaft portion or a golf club head with a hosel portion. The connection assembly includes male and female adaptors, a spring, a plurality of metal balls, and a retainer.

Another aspect of the present invention is a golf club shaft connection assembly comprising a golf club head, a first shaft section, a second shaft section, a male adaptor comprising a first body portion, a first protrusion, and a first ledge portion between the first body portion and the first protrusion, a female adaptor comprising a second body portion, a second protrusion, and a second ledge portion between the second body portion and the second protrusion, a hollow retainer comprising a first upper end, a first lower end, and an internal flange disposed proximate the first upper end, a spring comprising a second upper end and a second lower end, and a plurality of balls, wherein each of the first body portion and the second body portion is affixed to one of the first shaft section and the second shaft section, wherein the golf club head is affixed to one of the first shaft section and the second shaft section, wherein the first protrusion comprises a stem portion, a keyed portion, and a first groove between the stem portion and the keyed portion, wherein the second protrusion comprises a base portion and a hollow extension, wherein the hollow extension comprises an external surface, a second upper end, a second lower end proximate the base portion, a keyed interior, and a plurality of circular through-bores disposed proximate the second upper end, wherein the hollow retainer is disposed around the hollow extension such that the internal flange is located proximate the second upper end, wherein the internal flange comprises an upper surface and a lower surface, wherein the spring is coiled around the hollow extension such that the second lower end abuts the base portion and the second upper end abuts the lower surface of the internal flange, wherein each of the plurality of balls is partially disposed within one of the plurality of circular through-bores above the upper surface of the internal flange, wherein the keyed portion is sized to fit within the keyed interior, and wherein moving the retainer towards the first ledge portion removably fixes the male adaptor to the female adaptor.

In some embodiments of the present invention, the plurality of circular through-bores may encircle the upper end of the hollow extension. In other embodiments, the keyed portion may comprise a plurality of second grooves, and each of the plurality of second grooves may be linear and may comprise a concave cross-section. In a further embodiment, the keyed interior may comprise a plurality of ridges, and each of the plurality of ridges may be sized to fit within one of the plurality of second grooves, which may comprise four linear grooves. In some embodiments, the first groove may encircle the first protrusion and may comprise a concave cross-section. In a further embodiment, each of the plurality of balls may engage the first groove when the first upper end abuts the first ledge portion.

In one embodiment, the golf club shaft connection assembly may further comprise a retainer clip, which may be affixed to the upper end of the hollow extension above the through-bores and the upper surface of the internal flange, and each of the plurality of balls may be disposed between the retainer clip and the upper surface of the internal flange. In other embodiments, each of the plurality of balls may comprise a first diameter, each of the plurality of through-bores may comprise a second diameter, and the first diameter may be greater than the second diameter. In yet another embodiment, the hollow retainer may have a first length and the hollow extension may have a second length that may be greater than the first length.

In some embodiments, the upper surface of the internal flange may be angled and the lower surface of the internal flange may be planar. In others, each of the first and second body portions may be hollow. In some embodiments, the hollow retainer may be a cylindrical tube. In still other embodiments, each of the first and second body portions may comprise external ribs. In a further embodiment, each of the first shaft section and second shaft section may be hollow, and each of the first body portion and the second body portion may be affixed within one of the first shaft section and the second shaft section. In another embodiment, each of the first and second body portions may be permanently affixed within one of the first shaft section and the second shaft section with an adhesive material.

In any of the embodiments, each of the first and second shaft sections may be composed of a steel material. In any of the embodiments, each of the male adaptor, female adaptor, spring, plurality of balls, and hollow retainer may be composed of a metal material, which may be selected from the group consisting of titanium alloy, aluminum alloy, and steel. In other embodiments, the golf club head may be a putter-type head.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The present invention is directed to a golf club shaft connection assembly that permits golfers to adjust the overall length of their club shafts. Shaft length adjustability is an advantageous feature for golf clubs, and particularly drivers, because extending the length of a club can increase club head speed, which results in longer driving distances. Conversely, shortening the length of a club's shaft can provide a golfer with more control and accuracy in driving the golf ball. Golf course conditions often require accurate driving due to hazards, including but not limited to water, rough, and out of bounds markers, and driving accuracy can be more preferred than driving distance in competitive situations.

The present invention is also valuable because a golfer's swing may change over time, thus requiring alterations to his or her clubs. A golfer may improve his or her game through lessons and may gain greater flexibility and strength through practice and exercise. Therefore, it is reasonable for a golfer to wish to change his or her club's length to help improve his or her accuracy, distance, and feel as needed or desired.

The present invention provides golfers with a system that allows them to quickly and inexpensively modify the length of their golf clubs so they perform in a desired manner. This invention will enable golfers to change their club length wherever they wish, including, but not limited to, at the practice range, the golf course, and their home. The present invention also is designed to avoid altering a club's swing weight or its "feel." No tools are required to make an adjustment, and the technical ability required to modify the golf club length according to this invention is minimal and its approach is intuitive and easy for a golfer to understand.

Figure 1:
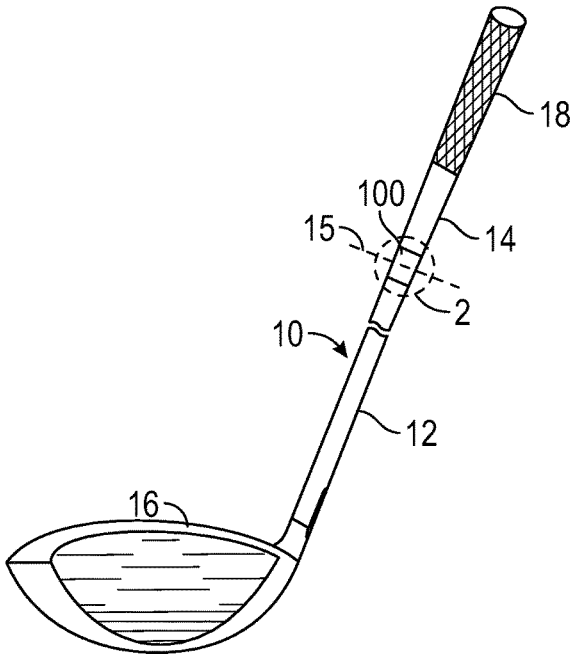
FIG. 1 is an elevational view of a golf club head incorporating the connection assembly of the present invention

A preferred embodiment of the shaft connection assembly 100 of the present invention is shown in FIGS. 1-9. According to this embodiment of the invention, and as shown in FIG. 1, two hollow sections of the shaft 10, the lower shaft section 12, which may be permanently or removably connected to a golf club head 16, and the upper shaft section 14, which includes a grip 18, are joined together along a demarcation line 15, the line at which the two shaft sections 12, 14 meet. The shaft sections 12, 14 are connected to one another with the connection assembly 100 shown in FIGS. 2-9, which comprises a male adaptor 20, a female adaptor 40, a hollow retainer 60, a retainer clip 80, a spring 90, and at least two balls 92, 94 made of metal or another resilient material.

Figure 4:
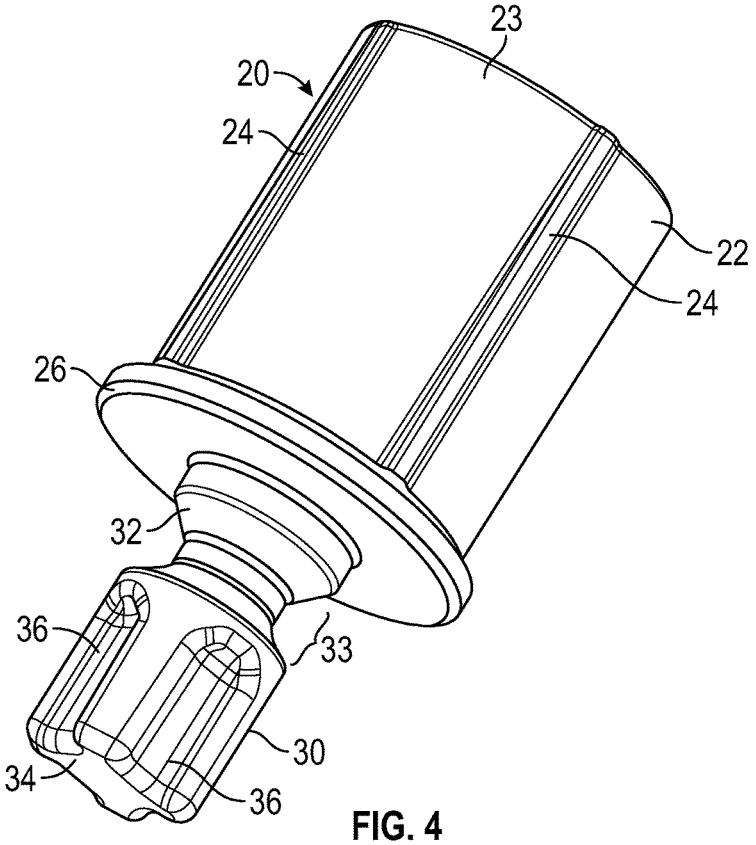
FIG. 4 is a side perspective view of the male adaptor piece of the connection assembly shown in FIG. 2.
Figure 8:
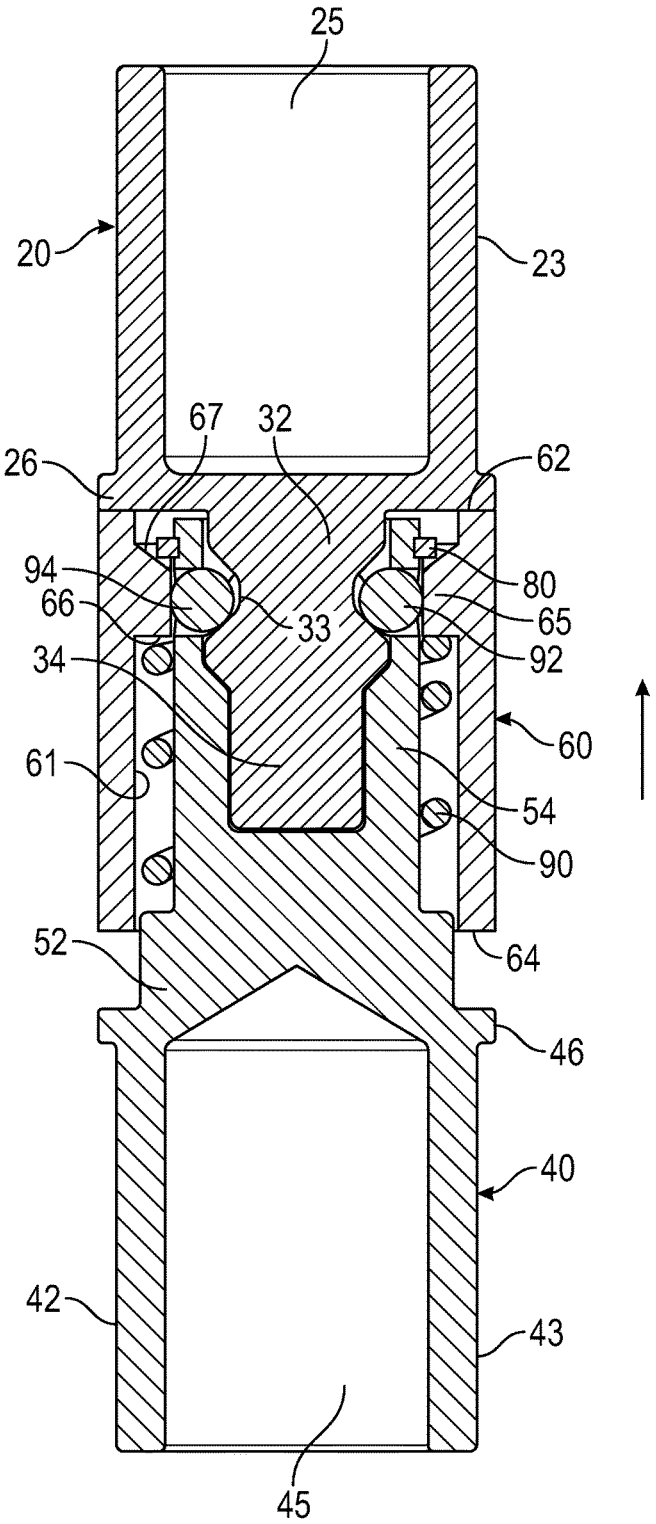
FIG. 8 is a cross-sectional view of the connection assembly shown in FIG. 2 along lines 8-8 in a closed configuration.
Figure 9:
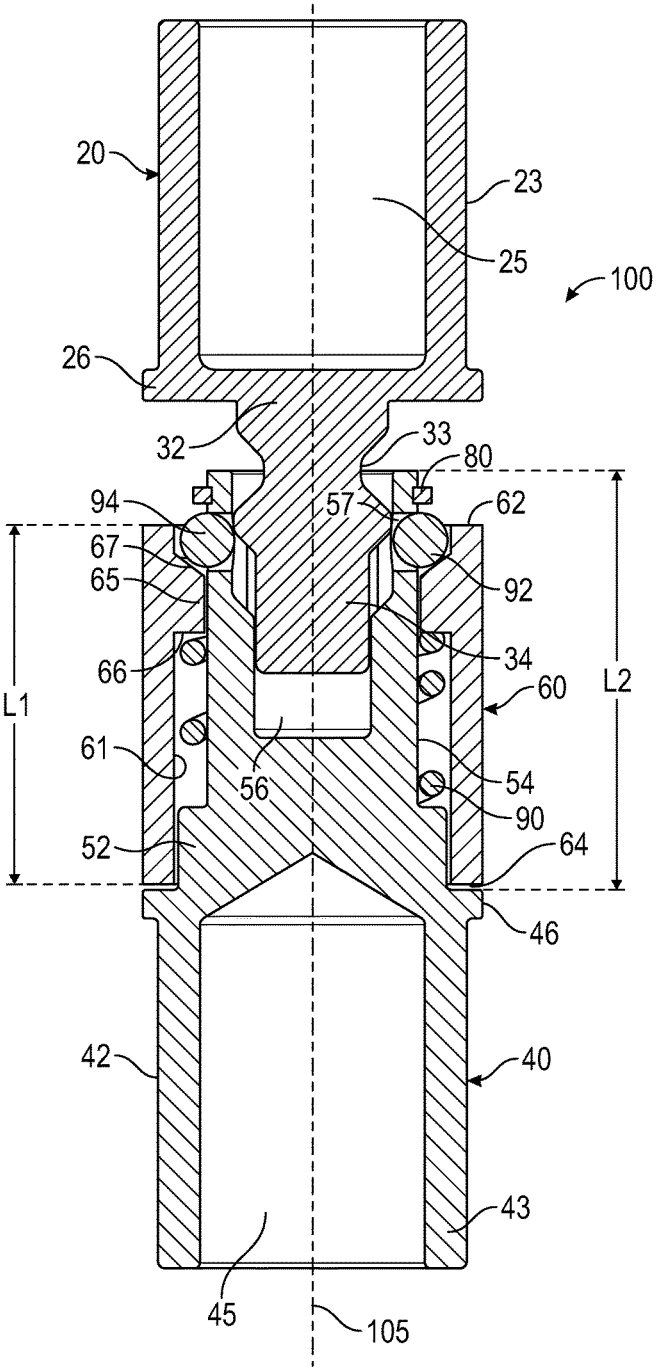
FIG. 9 is a cross-sectional view of the connection assembly shown in FIG. 8 in an open configuration.

As shown in FIGS. 4, 8, and 9, the male adaptor 20 includes a hollow body portion 22 with an outer surface 23 having a plurality of ribs 24 extending along the length of the body portion 22, a hollow interior 25, a ledge portion 26 disposed at a lower end of the body portion 22, and a contoured protrusion 30 extending perpendicularly away from the ledge portion 26. The hollow interior 25 reduces the overall mass of the male adaptor 20, the body portion 22 of which is inserted into a hollow interior of either the lower or upper shaft sections 12, 14 and then bonded therein. The ribs 24 allow the body portion 22 to fit more securely inside one of the shaft sections 12, 14 and provide additional bonding surface for whichever adhesive is applied to the outer surface 23 to bond the male adaptor 20 to the shaft section 12, 14.

The contoured protrusion 30 preferably is a solid piece that includes a stem portion 32, a keyed bulb portion 34 including a plurality of concave linear grooves 36 extending along most of the length of the bulb portion 34, and a concave groove 33 encircling the contoured protrusion 30 and separating the stem portion 32 from the bulb portion 34. In the preferred embodiment, the bulb portion 34 is approximately rectangular and has four concave linear grooves 36, one extending along each longitudinal side of the bulb portion 34. Each of the concave linear grooves 36 has a cross-sectional curvature that matches the curvature of the at least two balls 92, 94.

As shown in FIGS. 3 and 5-9, the female adaptor 40 also includes a body portion 42 with an outer surface 43 comprising a plurality of ribs 44 extending along the length of the body portion 42, a hollow interior 45, a ledge portion 46 disposed at a lower end of the hollow body portion 42, and a contoured protrusion 50 extending perpendicularly away from the ledge portion 46. The hollow interior 45 reduces the overall mass of the female adaptor 40, the body portion 42 of which is inserted into a hollow interior of either the lower or upper shaft sections 12, 14 and then bonded therein. The ribs 44 allow the body portion 42 to fit more securely inside one of the shaft sections 12, 14 and provide additional bonding surface for whichever adhesive is applied to the outer surface 43 to bond the female adaptor 40 to the shaft section 12, 14.

Figure 6:
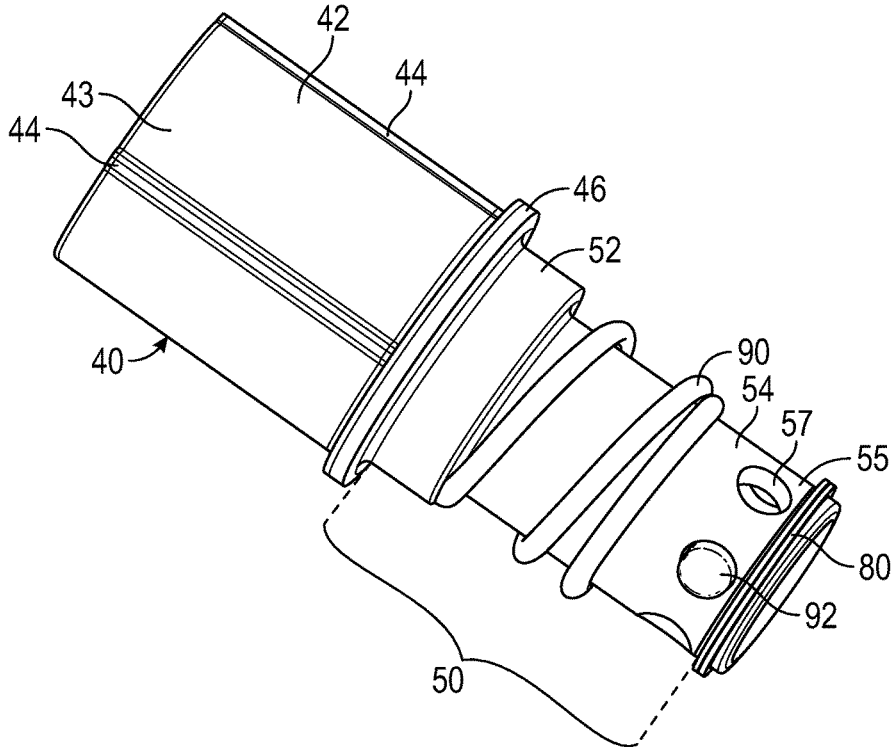
FIG. 6 is a side elevational view of connection assembly shown in FIG. 5 with the hollow retainer removed.
Figure 7:
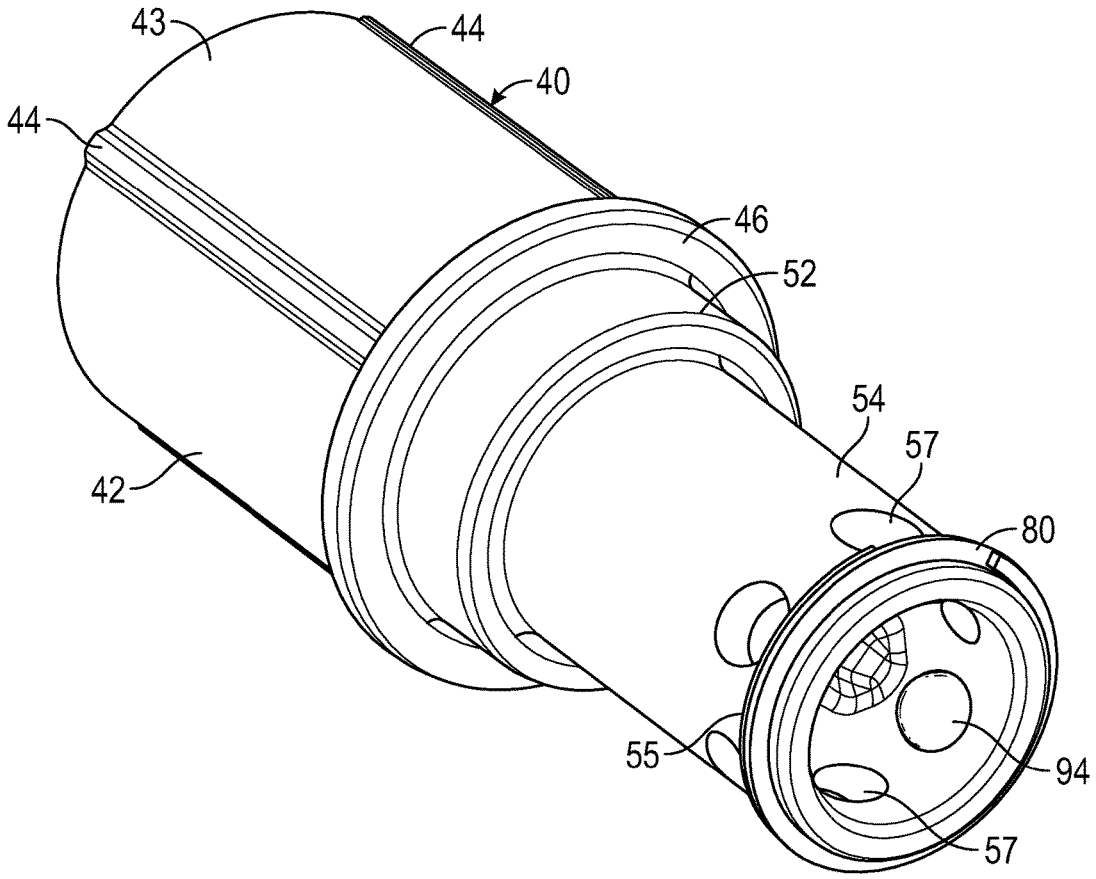
FIG. 7 is a side perspective view of the female adaptor piece shown in FIG. 6 engaged with the retainer clip and a single metal ball.

The contoured protrusion 50 includes a solid base portion 52 and a cylindrical, hollow extension 54 with a ridged, keyed interior 56 sized to receive the contoured protrusion 30 of the male adaptor 20. The upper end 55 of the hollow extension 54 comprises a plurality of through-bores 57 sized to receive the at least two balls 92, 94. The through-bores 57 are circular and have a diameter that is slightly smaller than that of the balls 92, 94, such that the balls 92, 94 cannot completely fit through the through-bores 57, and instead can only rest partially within the through-bores 57 at the external surface 58 of the hollow extension 54. As shown in FIG. 6, the spring 90 is coiled around the circumference of the hollow extension 54 such that a first end 91 of the spring 90 abuts the base portion 52, while the retainer clip 80 encircles the upper end 55 of the hollow extension 54 above the through-bores 57.

Figure 2:
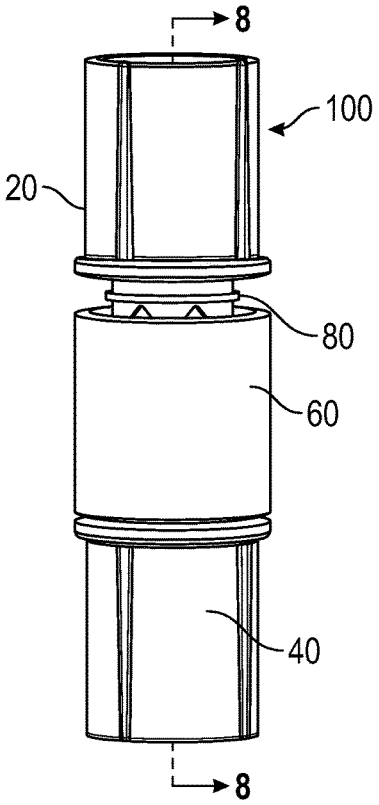
FIG. 2 is a side elevational view of the connection assembly circled in FIG. 1 in an open configuration, without the shaft sections.
Figure 3:
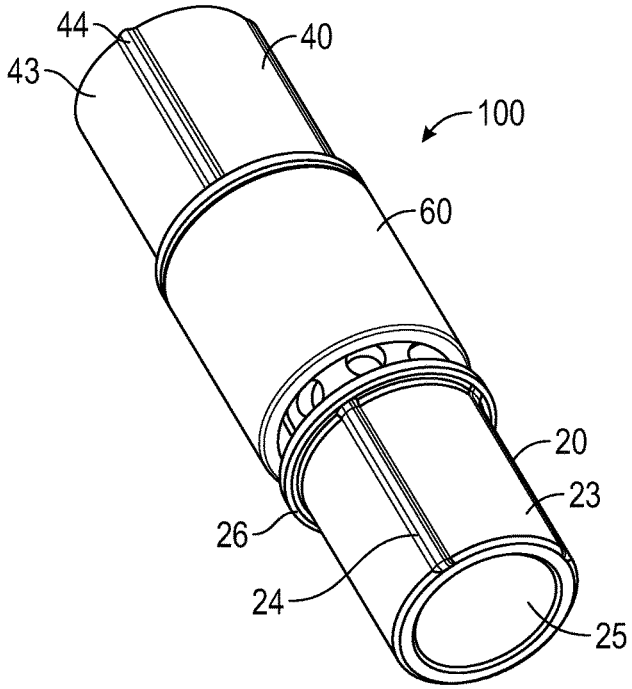
FIG. 3 is a side perspective view of the connection assembly shown in FIG. 2.
Figure 5:
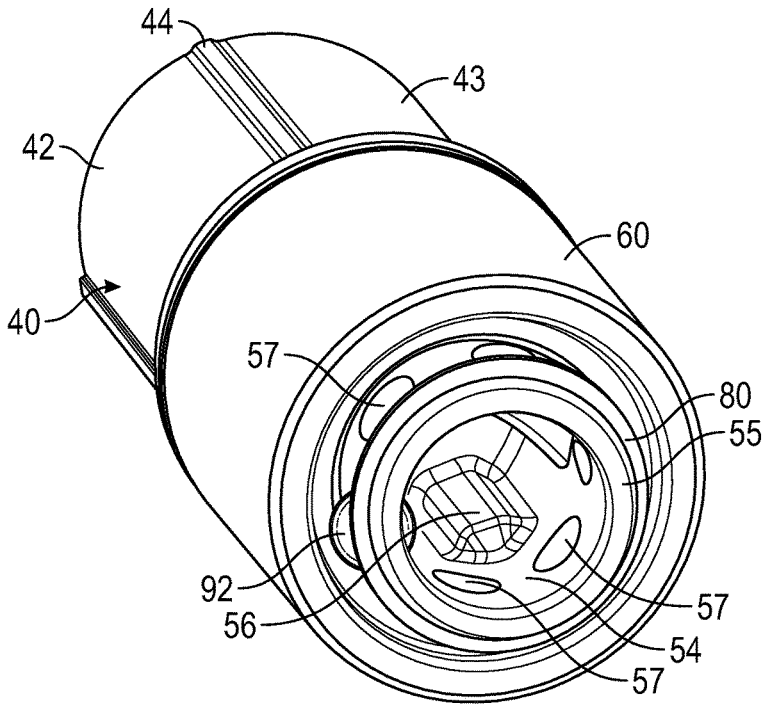
FIG. 5 is a side perspective view of the connection assembly shown in FIG. 2 with the male adaptor piece removed.

As shown in FIGS. 2, 3, and 5, the retainer 60 is a cylindrical tube that receives, and almost completely obscures, the hollow extension 54 portion of the female adaptor 40. The retainer 60 includes an upper end 62 and a lower end 64, each of which abuts a ledge portion 26, 46 on one of the male adaptor 20 and female adaptor 40, respectively, when the connection assembly 100 is fully assembled and in a closed position. The retainer 60 also includes an internal flange 65 extending from an interior surface 61 proximate the upper end 62. The internal flange 65 has a planar lower surface 66 and an angled upper surface 67 that tapers towards the interior surface 61 of the retainer 60. The retainer 60 has a length $L_1$ that is slightly less than that of the length $L_2$ of the hollow extension 54 so that there is room for the retainer 60 to move along the longitudinal axis 105 of the connection assembly 100.

As shown in FIGS. 8 and 9, when the retainer 60 is engaged with the hollow extension 54, the internal flange 65 is located slightly below the through-bores 57 encircling the upper end 55 of the hollow extension, and the spring 90 is trapped between the planar lower surface 66 of the internal flange 65 and the base portion 52 of the hollow extension 54. The retainer clip 80 is disposed above the internal flange 65 and, when attached to the upper end 55 of the hollow extension 54, prevents the retainer 60 from falling off of the hollow extension 54. The dimensions of the retainer clip 80 and the retainer 60 serve to prevent the balls 92, 94 from disengaging from the connection assembly 100, while still giving them room to move.

FIGS. 8 and 9 illustrate how the parts of the connection assembly 100 fit together and operate. FIG. 8 shows the connection assembly in a "closed" configuration, in which the contoured protrusion 30 of the male adaptor 20 is trapped within the hollow extension 54 of the female adaptor 40 so that the shaft sections 12, 14 are fixed together. FIG. 9 shows the connection assembly in an "open" configuration, in which the male adaptor 20 can be removed from the female adaptor 40 and therefore the shaft sections 12, 14 can be separated from one another.

The upward force exerted by the spring 90 causes the "closed" configuration to be the default state of the connection assembly 100. In this state, when the concave linear grooves 36 of the bulb portion 34 mate with the ridges in the keyed interior 56 of the hollow extension 54 so that the contoured protrusion 30 is fully engaged with the hollow extension 54, the spring 90 pushes the internal flange 65, and thus the retainer 60, away from the base portion 52 of the contoured protrusion 50 until the upper end 62 of the retainer 60 abuts the ledge portion 26 of the male adaptor 20. In doing so, the angled upper surface 67 of the internal flange 65 forces each of the balls 92, 94 further into their respective through-bores 57 such that they make contact with, and apply pressure to, the concave groove 33 on the bulb portion 34 of the contoured protrusion 30. The pressure from the balls 92, 94 serves to lock the contoured protrusion 30 within the keyed interior 56 of the hollow extension 54.

The connection assembly 100 is placed in the "open" configuration when a golfer pulls the retainer 60 downwards towards the body portion 42 of the female adaptor 40 until the lower end 64 abuts the ledge portion 46 of the female adaptor 40. This motion compresses the spring 90 between the internal flange 65 and the base portion 52, such that, if the retainer 60 is released, it will automatically revert into its locked configuration. Moving the retainer 60 towards the body portion 42 of the female adaptor releases the pressure placed by the internal flange 65 of the retainer 60 on the balls 92, 94, which disengage from the through-bores 57 enough to release the pressure on the concave groove 33 of bulb portion 34 of the contoured protrusion 30. This effectively "unlocks" the contoured protrusion 30, and thus the male adaptor 20, from the hollow extension 54 of the female adaptor 40.

The parts of the connection assembly 100 of the present invention may be composed of any number of materials, including metals, plastics, rubbers, and composites. The shaft sections 12, 14, adaptors 20, 40, retainer 60, retainer clip 80, and balls 92, 94 may be composed of titanium, graphite or carbon composite, plastic, magnesium, aluminum, steel, or alloys of such materials, specifically stainless steel 17-7 or titanium 6-4. The shaft sections 12, 14 preferably are composed of graphite or steel. The grip 18 preferably is composed of a rubber material. The adaptors 20, 40, retainer 60, retainer clip 80, and balls 92, 94 preferably are composed of a metal material, and most preferably a stainless steel material. The golf club head 16 preferably is a driver-type head, but may in alternative embodiments be a putter-type head, a fairway wood-type head, an iron-type head, a hybrid-type head, or a wedge-type head.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A golf club shaft connection assembly comprising:

a golf club head;

a first shaft section;

a second shaft section;

a male adaptor comprising a first body portion, a first protrusion, and a first ledge portion between the first body portion and the first protrusion;

a female adaptor comprising a second body portion, a second protrusion, and a second ledge portion between the second body portion and the second protrusion;

a hollow retainer comprising a first upper end, a first lower end, and an internal flange disposed proximate the first upper end;

a spring comprising a second upper end and a second lower end; and a plurality of balls, wherein each of the first body portion and the second body portion is affixed to one of the first shaft section and the second shaft section, wherein the golf club head is affixed to one of the first shaft section and the second shaft section, wherein the first protrusion comprises a stem portion, a keyed portion, and a first groove between the stem portion and the keyed portion, wherein the second protrusion comprises a base portion and a hollow extension, wherein the hollow extension comprises an external surface, a second upper end, a second lower end proximate the base portion, a keyed interior, and a plurality of circular through-bores disposed proximate the second upper end, wherein the hollow retainer is disposed around the hollow extension such that the internal flange is located proximate the second upper end, wherein the internal flange comprises an upper surface and a lower surface, wherein the spring is coiled around the hollow extension such that the second lower end abuts the base portion and the second upper end abuts the lower surface of the internal flange, wherein each of the plurality of balls is partially disposed within one of the plurality of circular through-bores above the upper surface of the internal flange, wherein the keyed portion is sized to fit within the keyed interior, and wherein moving the retainer towards the first ledge portion removably fixes the male adaptor to the female adaptor.

2. The golf club shaft connection assembly of claim 1, wherein the plurality of circular through-bores encircles the upper end of the hollow extension.

3. The golf club shaft connection assembly of claim 1, wherein the keyed portion comprises a plurality of second grooves, and wherein each of the plurality of second grooves is linear and comprises a concave cross-section.

4. The golf club shaft connection assembly of claim 3, wherein the keyed interior comprises a plurality of ridges, and wherein each of the plurality of ridges is sized to fit within one of the plurality of second grooves.

5. The golf club shaft connection assembly of claim 3, wherein the plurality of second grooves comprises four linear grooves.

6. The golf club shaft connection assembly of claim 1, wherein the first groove encircles the first protrusion and comprises a concave cross-section.

7. The golf club shaft connection assembly of claim 6, wherein each of the plurality of balls engages the first groove when the first upper end abuts the first ledge portion.

8. The golf club shaft connection assembly of claim 1, further comprising a retainer clip, wherein the retainer clip is affixed to the upper end of the hollow extension above the through-bores and the upper surface of the internal flange, and wherein each of the plurality of balls is disposed between the retainer clip and the upper surface of the internal flange.

9. The golf club shaft connection assembly of claim 1, wherein each of the plurality of balls comprises a first diameter, wherein each of the plurality of through-bores comprises a second diameter, and wherein the first diameter is greater than the second diameter.

10. The golf club shaft connection assembly of claim 1, wherein the hollow retainer has a first length, wherein the hollow extension has a second length, and wherein the second length is greater than the first length.

11. The golf club shaft connection assembly of claim 1, wherein the upper surface of the internal flange is angled, and wherein the lower surface of the internal flange is planar.

12. The golf club shaft connection assembly of claim 1, wherein each of the first and second body portions is hollow.

13. The golf club shaft connection assembly of claim 1, wherein the hollow retainer is a cylindrical tube.

14. The golf club shaft connection assembly of claim 1, wherein each of the first and second body portions comprises external ribs.

15. The golf club shaft connection assembly of claim 14, wherein each of the first shaft section and second shaft section is hollow, and wherein each of the first body portion and the second body portion is affixed within one of the first shaft section and the second shaft section.

16. The golf club shaft connection assembly of claim 15, wherein each of the first and second body portions is permanently affixed within one of the first shaft section and the second shaft section with an adhesive material.

17. The golf club shaft connection assembly of claim 1, wherein each of the first and second shaft sections is composed of a steel material.

18. The golf club shaft connection assembly of claim 1, wherein each of the male adaptor, female adaptor, spring, plurality of balls, and hollow retainer is composed of a metal material.

19. The golf club shaft connection assembly of claim 18, wherein the metal material is selected from the group consisting of titanium alloy, aluminum alloy, and steel.

20. The golf club shaft connection assembly of claim 1, wherein the golf club head is a putter-type head.

* * * * *